US008505902B2

(12) United States Patent
Sugiyama et al.

(10) Patent No.: US 8,505,902 B2
(45) Date of Patent: Aug. 13, 2013

(54) SHEET PROCESSING APPARATUS, IMAGE FORMING SYSTEM AND SHEET PROCESSING METHOD

(75) Inventors: Hideaki Sugiyama, Shizuoka-ken (JP); Shinichiro Mano, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 94 days.

(21) Appl. No.: 13/192,226

(22) Filed: Jul. 27, 2011

(65) Prior Publication Data

US 2012/0028780 A1 Feb. 2, 2012

Related U.S. Application Data

(60) Provisional application No. 61/368,590, filed on Jul. 28, 2010, provisional application No. 61/372,436, filed on Aug. 10, 2010.

(30) Foreign Application Priority Data

Sep. 16, 2010 (JP) ..... P2010-207991

(51) Int. Cl.
*B41L 43/06* (2006.01)
*B31F 1/00* (2006.01)

(52) U.S. Cl.
USPC ..... 270/45; 270/32; 270/58.07

(58) Field of Classification Search
USPC ..... 270/32, 45, 51, 58.07; 493/406, 493/407, 442, 454
See application file for complete search history.

(56) References Cited

U.S. PATENT DOCUMENTS

| | | | | |
|---|---|---|---|---|
| 6,905,118 | B2 * | 6/2005 | Yamada et al. | 270/8 |
| 8,002,255 | B2 * | 8/2011 | Kawaguchi et al. | 270/45 |
| 2009/0036287 | A1 * | 2/2009 | Kawaguchi et al. | 493/442 |
| 2010/0007073 | A1 * | 1/2010 | Fukatsu et al. | 270/58.07 |

FOREIGN PATENT DOCUMENTS

| | | |
|---|---|---|
| JP | 3732812 | 1/2006 |
| JP | 3746472 | 2/2006 |

* cited by examiner

*Primary Examiner* — Leslie A Nicholson, III
(74) *Attorney, Agent, or Firm* — Patterson & Sheridan, LLP

(57) ABSTRACT

According to one embodiment, a sheet processing apparatus includes a reinforce roller to further reinforce the fold of a sheet which has been folded by a fold roller pair, a support portion to move the reinforce roller in a direction perpendicular to a sheet conveying direction, a motor to drive the support portion, and a control unit to control the motor so that the support portion moves at a faster moving speed at the time of a homeward route than a moving speed at the time of an outward route.

16 Claims, 21 Drawing Sheets

SHEET PROCESSING APPARATUS, IMAGE FORMING SYSTEM AND SHEET PROCESSING METHOD

CROSS-REFERENCE TO RELATED APPLICATION

This application is based upon and claims the benefit of priority from the prior U.S. Patent Application Nos. 61/368,590, filed on Jul. 28, 2010, and 61/372,436, filed on Aug. 10, 2010, the entire contents of which are incorporated herein by reference.

This application is also based upon and claims the benefit of priority from Japanese Patent Application No. 2010-207991, filed on Sep. 16, 2010, the entire contents of which are incorporated herein by reference.

FIELD

Exemplary embodiments described herein relate to a sheet processing apparatus, an image forming system and a sheet processing method provided with processing functions, such as, sorting, stapling and reinforcing functions.

BACKGROUND

With respect to the fold of a sheet at the time of reinforcing, sheet processing apparatuses are known which reinforce the fold of a sheet with a reinforce roller unit having a roller separate from a fold roller pair. However as the fold of a sheet is reinforced with the reinforce roller unit, there is a problem that a long time is required for folding operation.

DETAILED DESCRIPTION

In general, according to one embodiment, there is provided a sheet processing apparatus including a fold roller pair to fold a sheet being pushed into a nip thereof; a reinforce roller to reinforce a fold of the sheet folded by the fold roller pair; a support portion to move the reinforce roller in a direction perpendicular to a sheet conveying direction; a motor to drive the support portion; and a control unit to control the motor so that the support portion moves at a faster moving speed at the time of a homeward route than a moving speed at the time of an outward route.

Hereinafter, an embodiment of a sheet processing apparatus will be described with reference to the accompanied drawings.

First Embodiment

In a first embodiment, a reinforcing operation on the outward route is performed at a low speed, and a reinforcing operation on the homeward route is performed at a high speed.

Figure 1:
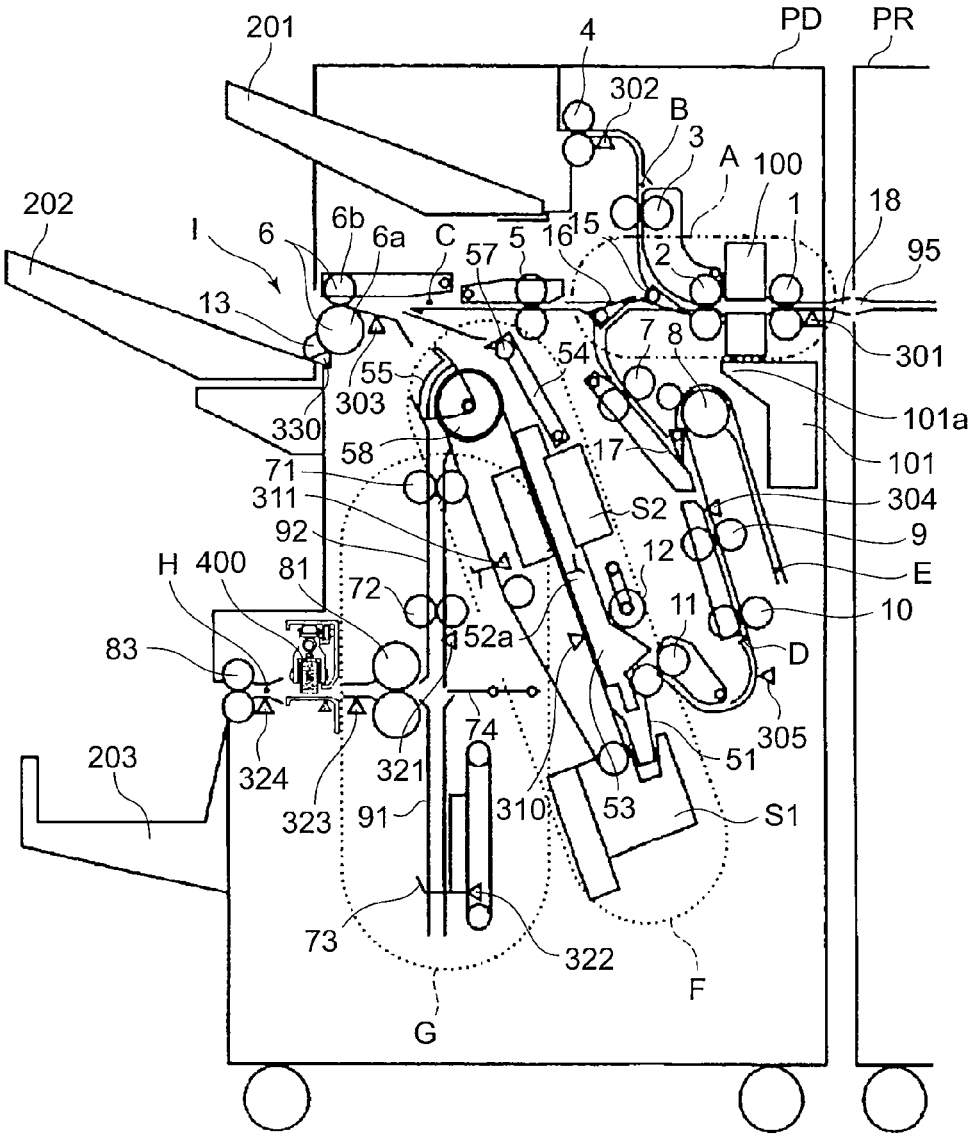
FIG. 1 is a construction view of a finisher in a first embodiment.

FIG. 1 shows a construction of an image forming system composed of a finisher PD as a sheet processing apparatus of a first embodiment and an image forming apparatus PR. FIG. 1 shows the whole of the finisher PD and a part of the image forming apparatus PR.

In FIG. 1, the finisher PD is fixed to the image forming apparatus PR, and a recording medium discharged from a sheet discharge port of the image forming apparatus PR is lead to an inlet 18 of the finisher PD. Here, a recording medium is a sheet. A sheet passes through a path A having finishing means for finishing the sheet, and then is sorted by path selectors 15, 16 into any one of a path B for leading the sheet to an upper tray 201, a path C for leading the sheet to a shift tray 202, a path D for leading the sheet to a processing tray F (hereinafter referred to also as a staple tray) which aligns, staples or otherwise processes the sheet or sheets.

The sheets led to the staple tray F through the paths A and D and then aligned and stapled in the staple tray F are sorted by a guide plate 54 and a movable guide 55 that composes deflecting means into the path C for leading the sheet to the shift tray 202 and a processing tray G (hereinafter referred to also as a fold processing tray) which folds or otherwise processes the sheets. The sheets which have been folded or otherwise processed in the fold processing tray G are further strongly folded by a reinforce roller unit 400, and then are lead to a lower tray 203 through a path H. In addition, a path selector 17 is arranged in the path D, and is kept in the state shown in FIG. 1 by a low load spring. After the back end of the sheet passes through the path selector 17, at least a conveying roller 9 out of the conveying rollers 9, 10 and a staple outlet roller 11, and a refeed roller 8 are rotated in the reverse direction to thereby lead the back end thereof to a prestacking portion E and to cause the sheet to stay there, and the sheet is conveyed together with the next sheet superposed thereon. Such an operation like this is repeated and thereby two or more sheets can also be conveyed in the superposed state.

On the path A which is mutual to the paths B, C, D, an inlet sensor 301 to sense the sheet received from the image forming apparatus PR is arranged at the upstream side, and at the down stream side thereof an input roller pair 1, a punch unit 100, a waste hopper 101, a conveying roller pair 2, the path selectors 15, 16 are sequentially arranged. The path selectors 15, 16 are maintained in the state shown in FIG. 1 by the springs, and when their solenoids are turned ON, the path selector 15 rotates upward and the path selector 16 rotates downward to thereby sort the sheet into one of the paths B, C, D.

The finisher PD selectively performs punching (the punch unit 100), jogging and edge stapling (jogger fences 53 and an edge stapler S1), jogging and center stapling (jogger fences 53 and center staplers S2), sorting (the shift tray 202) or center folding (a fold plate 74, a fold roller pair 81 and the reinforce roller unit 400) for a sheet or sheets.

Figure 2:
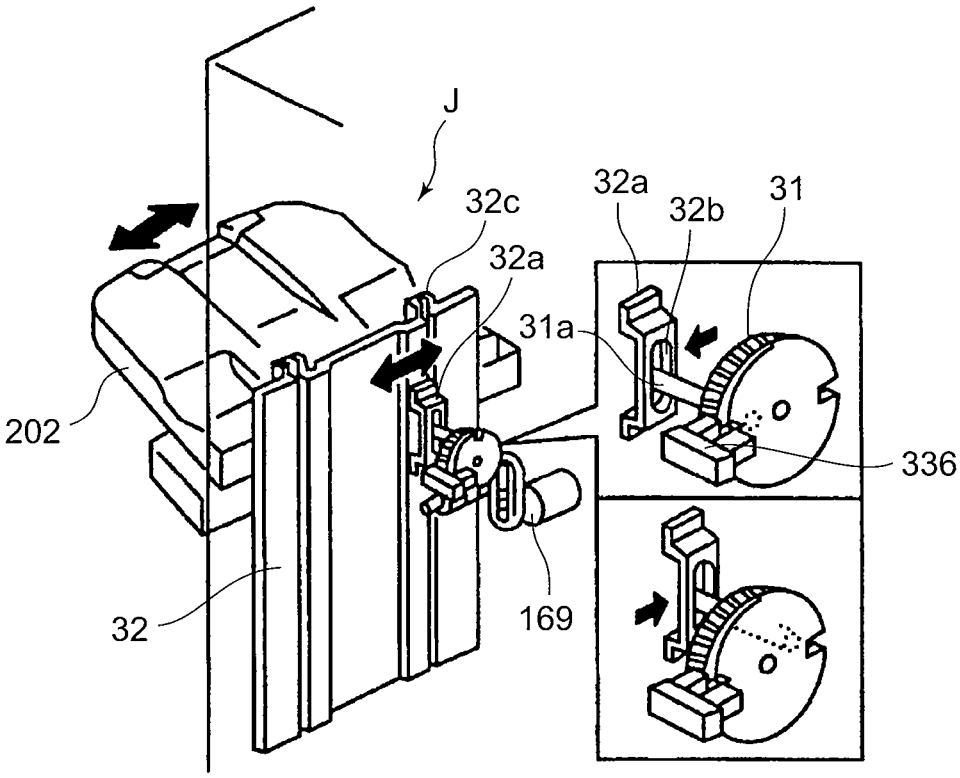
FIG. 2 is a perspective view showing a shifting mechanism in the first embodiment.
Figure 3:
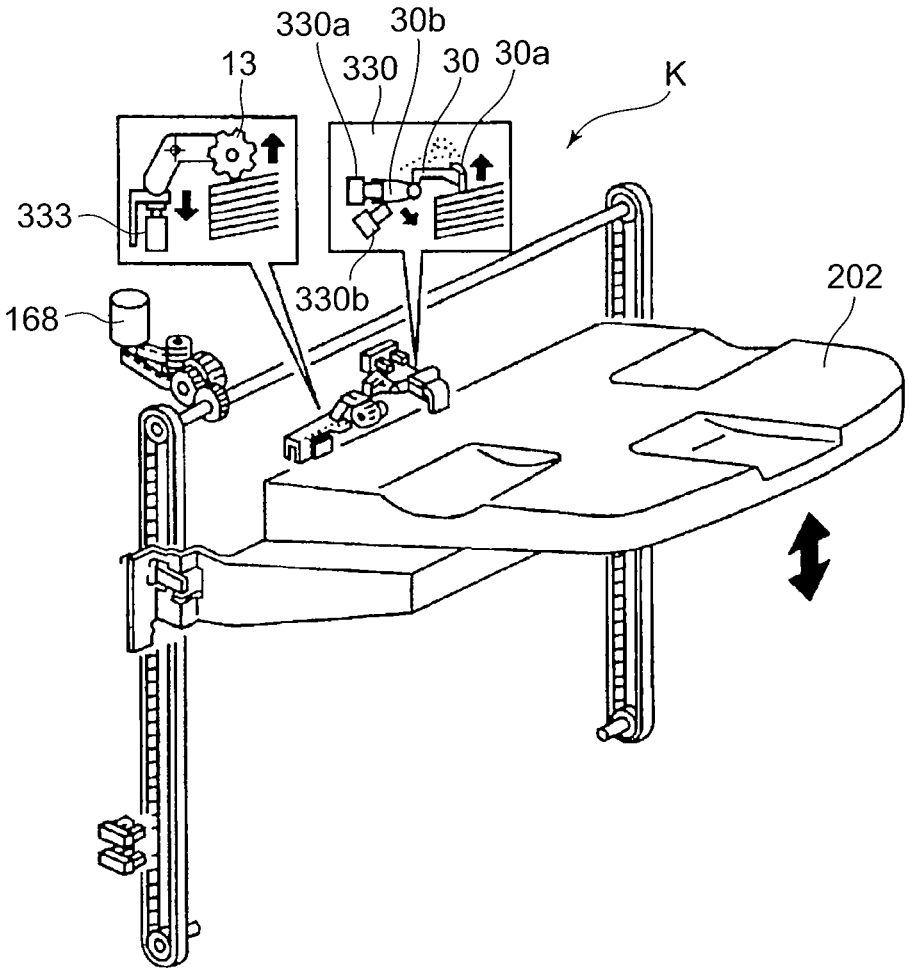
FIG. 3 is a perspective view showing a shift tray elevating mechanism in the first embodiment.

A shift tray outlet section I which is located at the most downstream position of the finisher PD includes shift outlet rollers 6, a return roller 13, a sheet surface sensor 330, the shift tray 202, a shifting mechanism J shown in FIG. 2 and a shift tray elevating mechanism K shown in FIG. 3. FIG. 2 is an enlarged perspective view of the main portion indicating the shifting mechanism J, and FIG. 3 is an enlarged perspective view of the main portion of the shift tray elevating mechanism K.

In FIGS. 1 and 3, the return roller 13 contacts a sheet discharged from the shift outlet rollers 6 and causes the back end of the sheet to abut against an end fence 32 shown in FIG. 2 for thereby aligning it. The return roller 13 is caused to be rotated by the rotation force of the shift outlet rollers 6. A limit switch 333 is arranged in the vicinity of the return roller 13, and when the shift tray 202 is lifted and raises the return roller 13, the limit switch 333 turns on to cause a tray motor 168 to stop rotating. This prevents the shift tray 202 from overrunning. Furthermore, as shown in FIG. 1, the sheet surface sensor 330 is provided as a sheet surface sensing means which senses a sheet surface position of a sheet or that of a sheet stack discharged out on the shift tray 202.

As shown in FIG. 3, the sheet surface censor 330 has a lever 30, a sheet surface sensor 330*a* (for stapling use) and a sheet surface sensor 330*b* (for non-stapling use). The lever 30 rotates around its shaft portion and has a contact end 30*a* which makes contact with the top of the back end of a sheet loaded on the shift tray 202 and a sectorial interrupter 30*b*.

When the sheet surface sensor 330*a* (for stapling use) and the sheet surface sensor 330*b* (for non-stapling use) sense that sheets are stacked on the shift tray 202 to a prescribed height, the tray motor 168 is driven to lower the shift tray 202 by a prescribed amount. The sheet surface position of the sheet stack on the shift tray 202 is therefore maintained at a substantially constant height.

Figure 4:
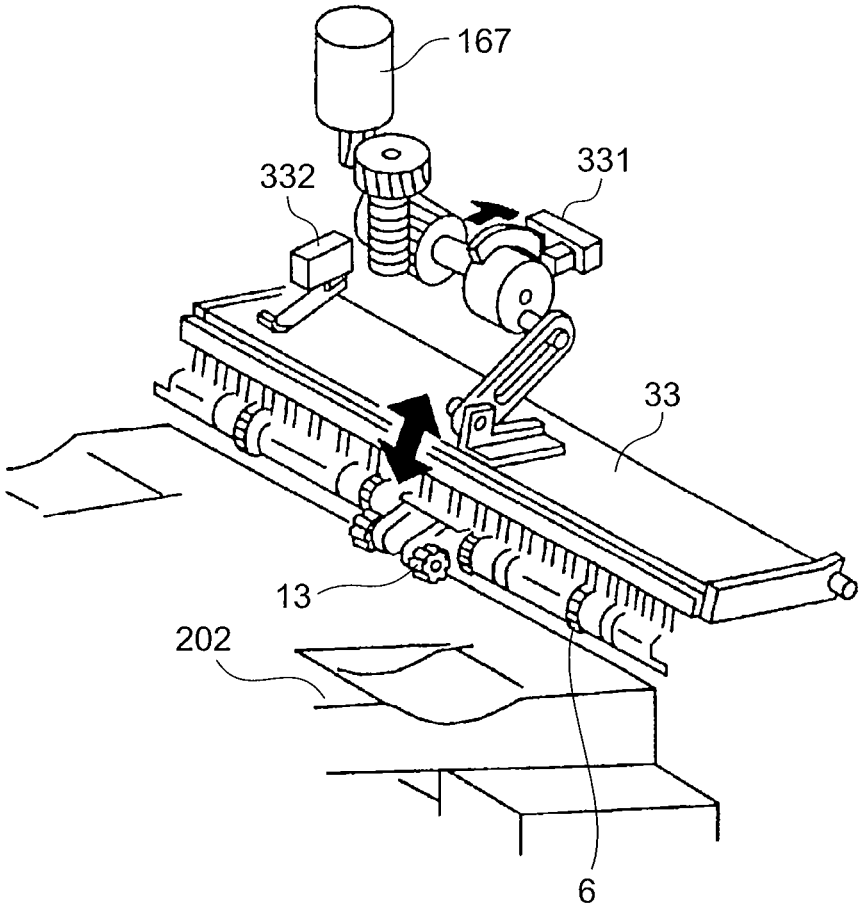
FIG. 4 is a perspective view showing an outlet section to the shift tray in the first embodiment.

FIG. 4 is a perspective view showing a construction of the outlet section I to the shift tray 202.

In FIGS. 1 and 4, the shift outlet roller 6 has a drive roller 6*a* and a driven roller 6*b*. The driven roller 6*b* is supported at its upstream side in the sheet discharge direction and is supported swingably in the up-and-down direction, and is rotatably supported to the free end of a guide plate 33. The driven roller 6*b* contacts the drive roller 6*a* due to its own weight or a biasing force, and a sheet is nipped between both the rollers 6*a*, 6*b* and is discharged.

When a stapled sheet stack is to be discharged, the guide plate 33 is lifted upward and then lowered at a prescribed timing. This timing is determined on the basis of a sensing signal of a shift outlet sensor 303. Its stop position is determined on the basis of a sensing signal of a guide plate sensor 331, and the guide plate 33 is driven by a guide plate motor 167. In addition, the guide plate motor 167 is drive controlled in accordance with the ON/OFF state of a limit switch 332.

A construction of the staple tray F for stapling will be described.

Figure 5:
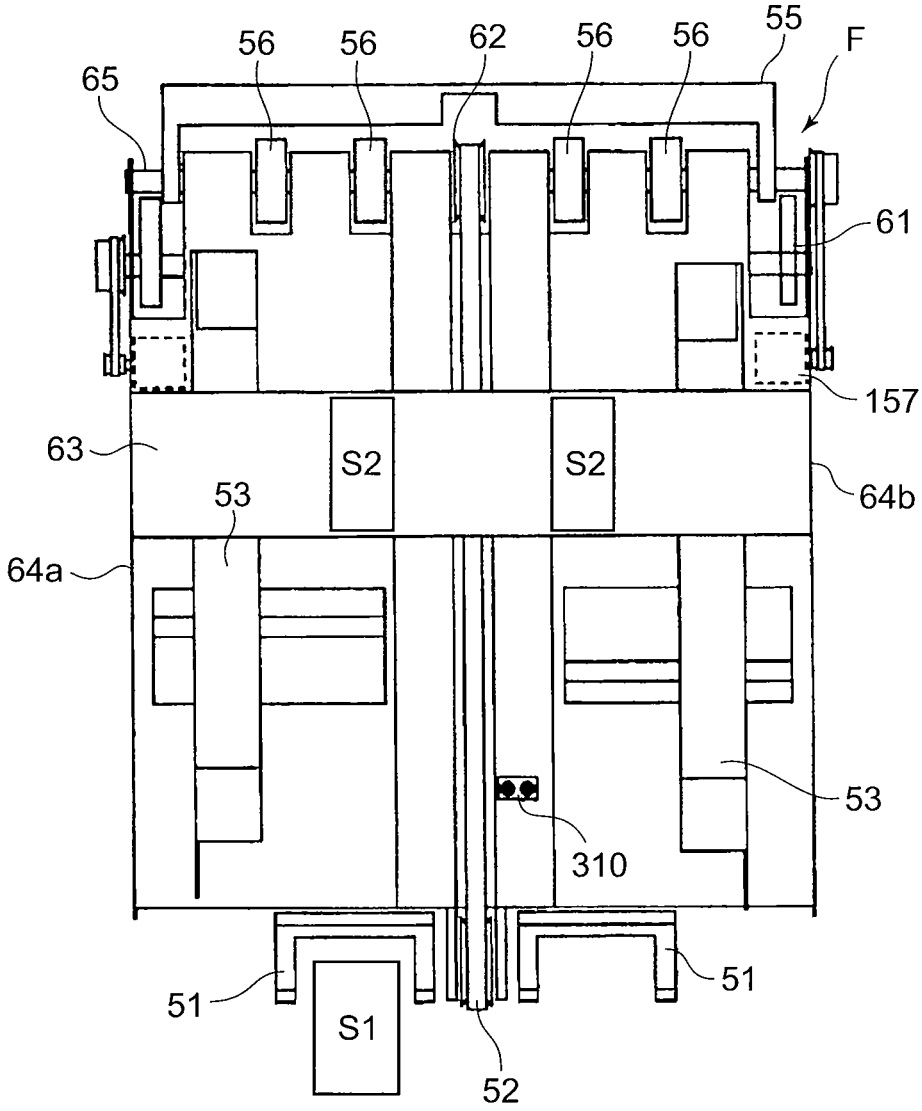
FIG. 5 is a plan view of a staple processing tray in the first embodiment as seen from a direction perpendicular to a sheet conveying plane.
Figure 6:
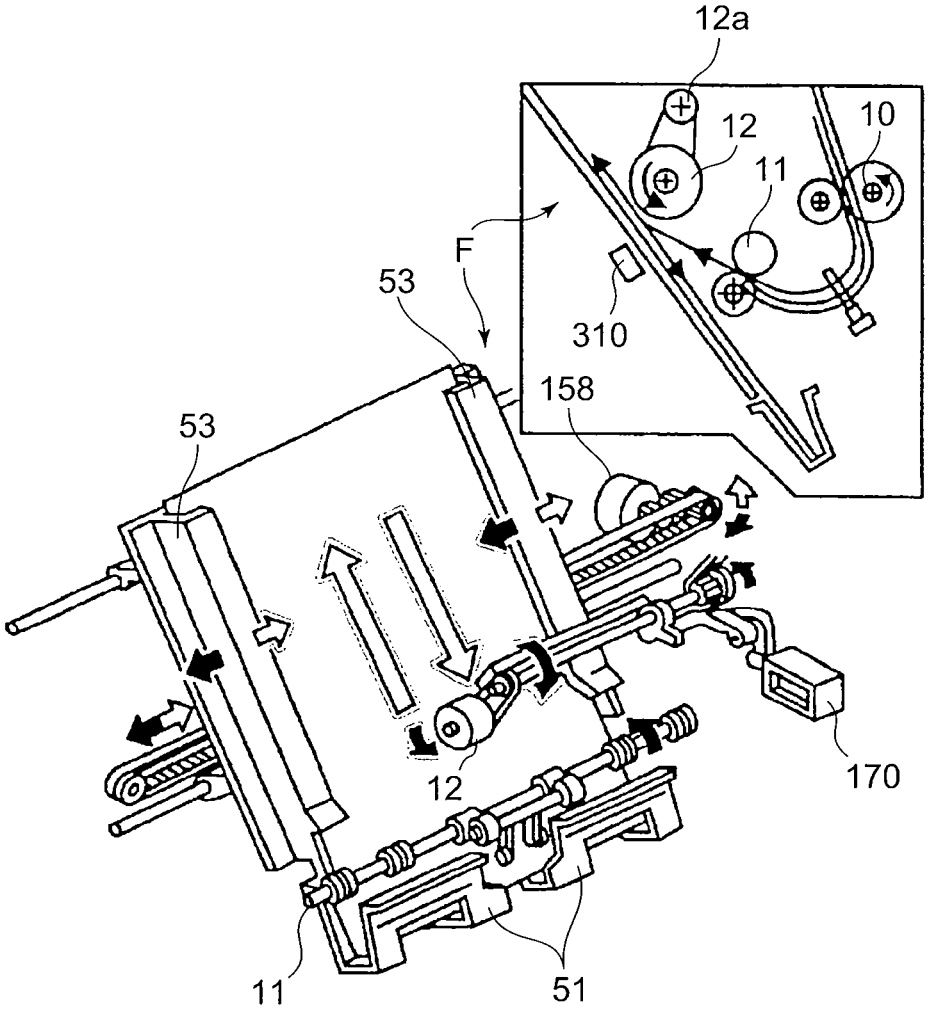
FIG. 6 is a perspective view showing the staple processing tray and its drive mechanism in the first embodiment.
Figure 7:
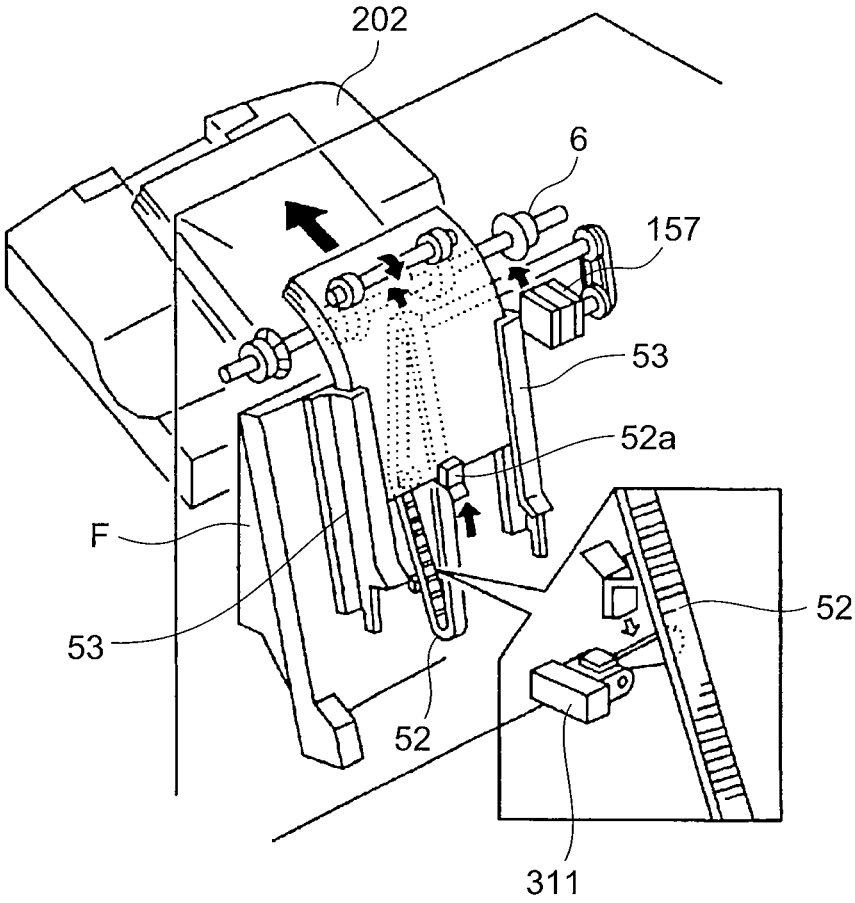
FIG. 7 is a perspective view showing a discharge mechanism of a sheet stack in the first embodiment.

FIG. 5 is a plan view of the staple tray F as seen from the direction perpendicular to the sheet conveying plane, FIG. 6 is a perspective view showing the staple tray F and its driving mechanism, and FIG. 7 is a perspective view showing a sheet stack discharging mechanism. As shown in FIG. 6, firstly sheets which are led by the staple outlet roller 11 to the staple tray F are sequentially stacked on the staple tray F. At this instant, a knock roller 12 aligns every sheet in the longitudinal direction (a sheet conveying direction), while jogger fences 53 aligns the sheet in the lateral direction (a direction perpendicular to the sheet conveying direction—sometimes referred to as a sheet width direction). Between consecutive jobs, i.e., during an interval between the last sheet of a sheet stack and the first sheet of the next sheet stack, an edge stapler S1 is driven by a staple signal from a control unit to thereby perform a stapling operation. The sheet stack which has been stapled is immediately conveyed to the shift outlet roller 6 by a discharge belt 52 with hooks 52*a* and is discharged to the shift tray 202 which is set at a receiving position.

As shown in FIG. 7, an HP sensor 311 senses the hook 52*a* of the discharge belt 52 brought to its home position. The HP sensor 311 is turned ON/OFF by the hook 52*a*. Two hooks 52*a* are arranged at spaced face-to-face positions on the outer circumference of the discharge belt 52, and alternately move and convey the sheet stacks housed on the staple tray F. The discharge belt 52 can be rotated in the reverse direction such that one hook 52*a* held in a stand-by position so as to move the sheet stack and the back of the other hook 52*a* at the opposite side align the leading end of the sheet stack housed in the staple tray F in the sheet conveying direction, as needed. The hook 52*a* function as aligning means of the sheet stack in the sheet conveying direction at the same time.

As shown in FIG. 5, a discharge motor 157 causes the discharge belt 52 to move via a discharge shaft 65. The discharge belt 52 and a drive pulley 62 therefor are positioned at the center of the discharge shaft 65 in the direction of sheet width. The discharge rollers 56 are mounted on the discharge shaft 65 in a symmetrical arrangement. The discharge rollers 56 rotate at a higher peripheral speed than the discharge belt 52.

As shown in FIG. 6, a solenoid 170 causes the knock roller 12 to move about a fulcrum 12*a* in a pendulum fashion, so that the knock roller 12 intermittently acts on the sheets transferred to the staple tray F and causes the sheets to abut against rear fences 51. In addition, the knock roller 12 rotates counterclockwise. The jogger fences 53 are driven by a jogger motor 158 rotatable in the forward and reverse directions via a timing belt, and move back and forth in the sheet width direction.

Figure 8:
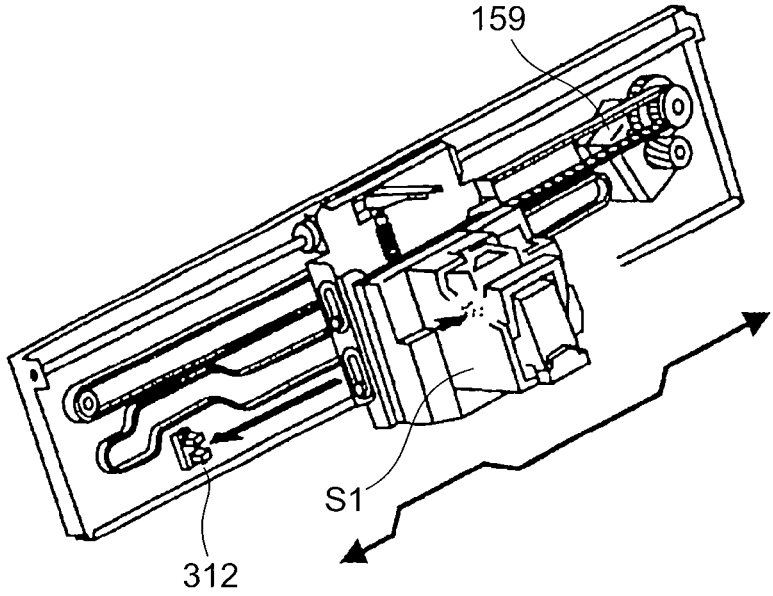
FIG. 8 is a perspective view showing an edge stapler and its moving mechanism in the first embodiment.
Figure 9:
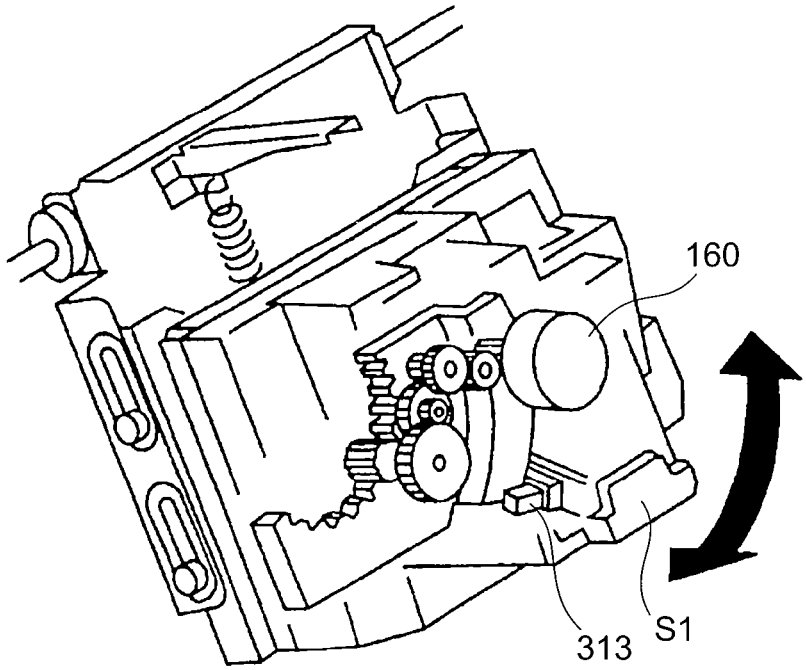
FIG. 9 is a perspective view showing an obliquely rotating mechanism in the first embodiment.

In FIG. 8, the edge stapler S1 is driven by a stapler motor 159 which is rotatable in the forward and reverse directions via a timing belt, and moves in the sheet width direction in order to staple a sheet stack at a prescribed position of the sheet end portion. A stapler HP sensor 312 to sense the home position of the edge stapler S1 is provided at one end of the movable range of the edge stapler S1, and the stapling position in the sheet width direction is controlled in terms of the displacement of the edge stapler S1 from the home position. As shown in the perspective view of FIG. 9, the edge stapler S1 is constructed so that a striking angle of a staple can be selectively set in parallel to or obliquely to the edge portion of the sheet, and so that only the stapling mechanism portion of the edge stapler S1 at the home position is made rotatable by a prescribed angle obliquely so as to replace staples easily. The edge stapler S1 is rotated obliquely by an oblique motor 160, and when a sensor 313 senses that the stapling mechanism has reached a prescribed oblique angle or a staple replacement position, the oblique motor 160 stops. After oblique stapling is finished or the replacement of staples is finished, the stapling mechanism is rotated to the original position to prepare for next stapling.

As shown in FIGS. 1 and 5, the center staplers S2 are arranged by two, fixed to a stay 63, and are arranged respectively at positions where the distance between the rear fences 51 and stapling positions of the center staplers S2 are not less than a distance corresponding to one-half of the length of the maximum sheet size that can be center stapled, as measured in the conveying direction, and are arranged symmetrically to each other with respect to the alignment center in the sheet width direction. In the case of center stapling, after a sheet stack is aligned by the jogger fences 53 in the direction perpendicular to the sheet conveying direction and is aligned in the sheet conveying direction by the rear fences 51 and the knock roller 12, the discharge belt 52 is driven to lift the back end portion of the sheet stack with its hook 52 to a position where the center portion of the sheet stack in the sheet conveying direction coincides with the stapling positions of the center staplers S2. The discharge belt 52 stops at this position and causes the center staplers S2 to staple the sheet stack. The stapled sheet stack is conveyed to the fold processing tray G side and is folded at the center.

In the drawings, a symbol 64*a* is a front side wall, 64*b* is a rear side wall, and a symbol 310 is a sheet sensor to sense the existence or non existence of the sheets on the staple tray F.

Figure 10:
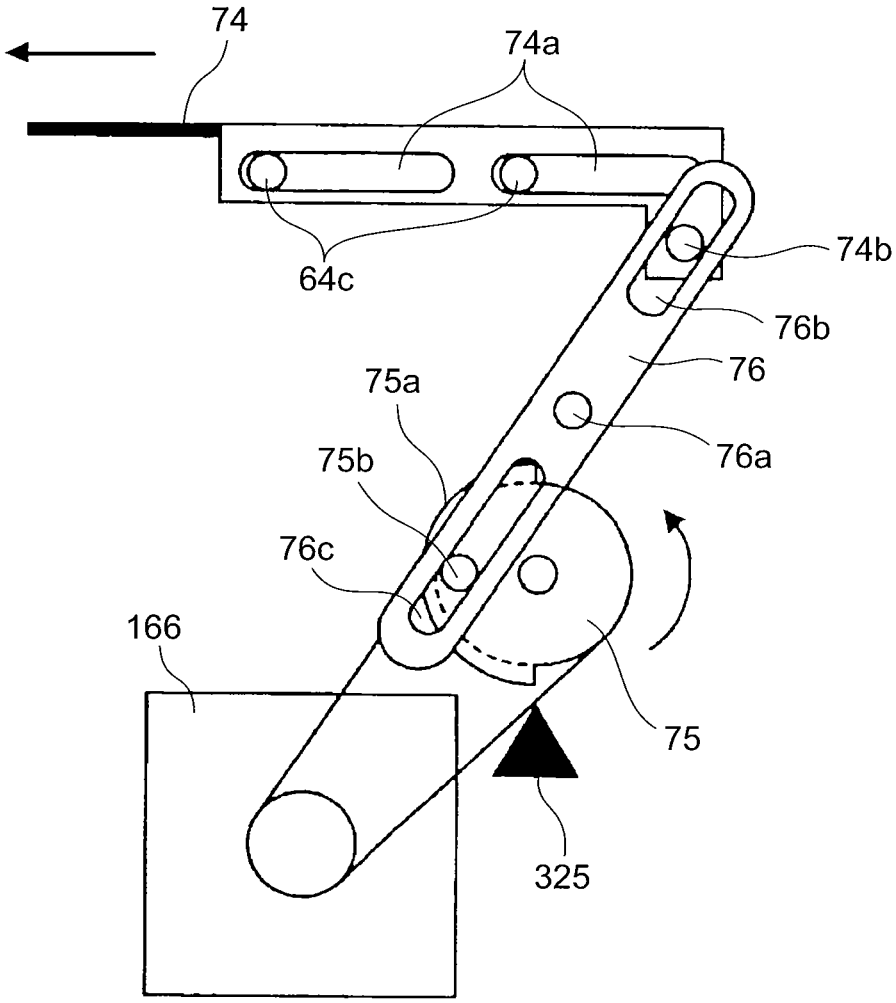
FIG. 10 is a view to describe an operation of a moving mechanism of a fold plate in the first embodiment, and shows a state before entering into a folding operation at the center.
Figure 11:
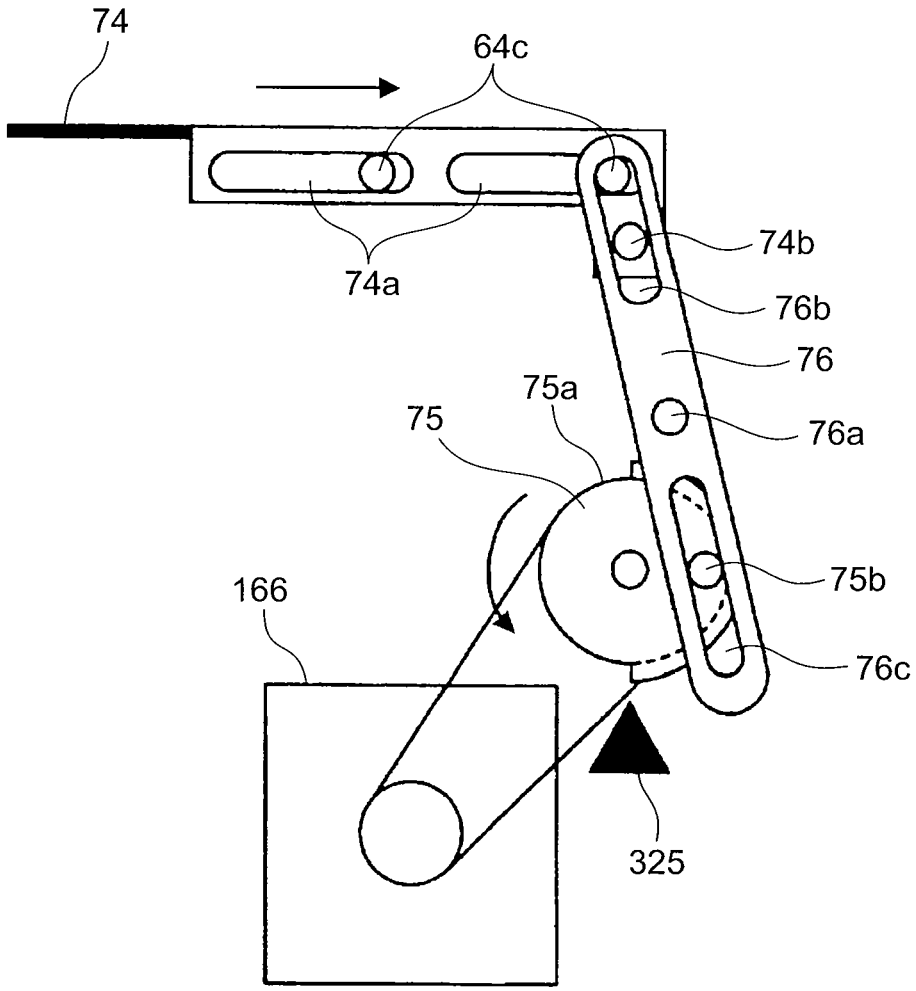
FIG. 11 is a view to describe an operation of the moving mechanism of the fold plate in the first embodiment, and shows a state to return to an original position after folding at the center.

FIG. 10 and FIG. 11 are views, each describing an operation of a moving mechanism of a fold plate 74 for center folding.

Figure 12:
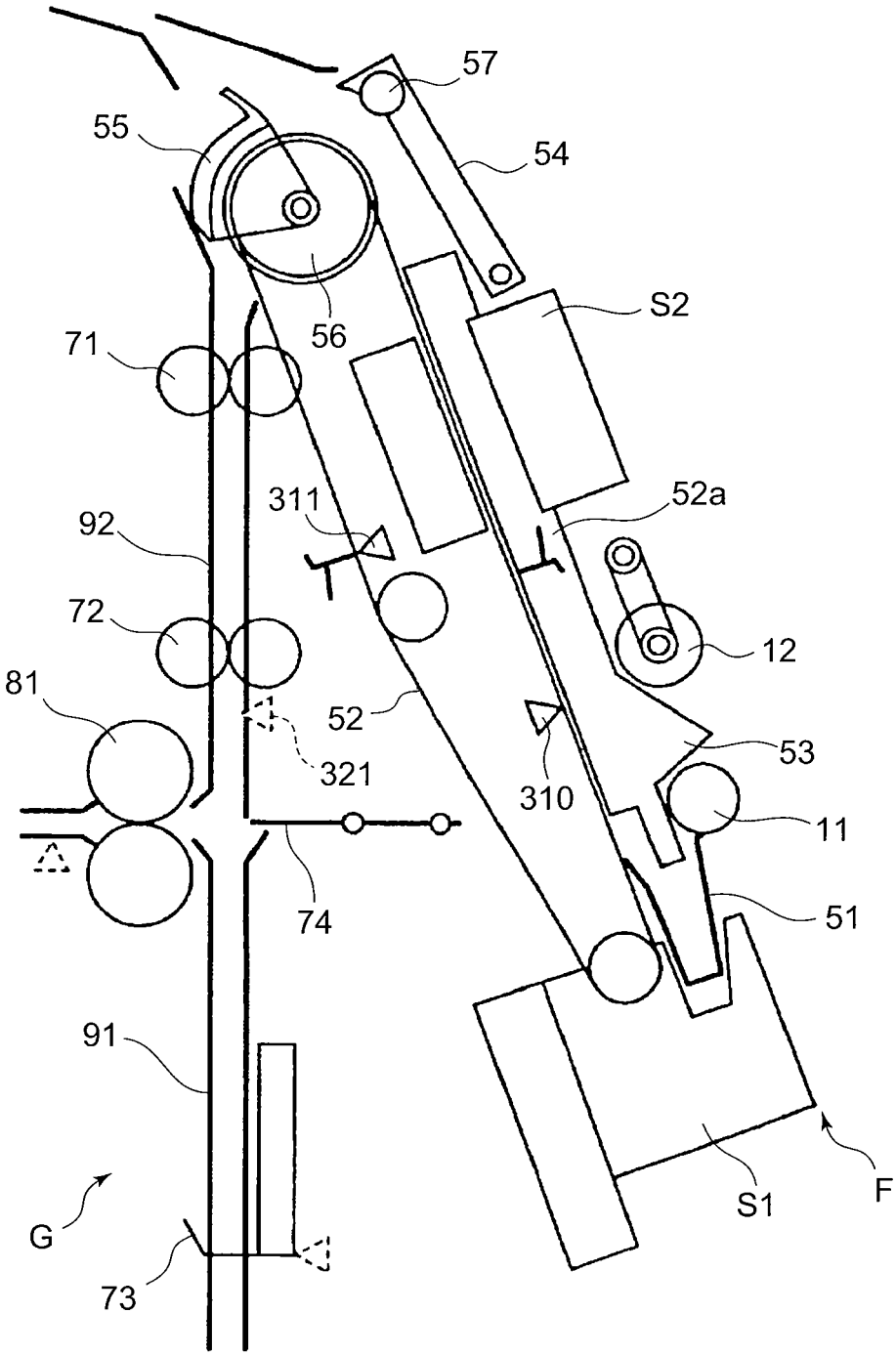
FIG. 12 is a view showing a staple processing tray and a fold processing tray in the first embodiment.

The fold plate 74 is supported in such a manner that each of elongate slots 74*a* formed in the fold plate 74 is movably received in one of two pins 64*c* studded on each of the front and rear side walls 64*a* and 64*b*. In addition, a pin 74*b* studded on the fold plate 74 is movably received in an elongate slot 76*b* formed in a link arm 76, and the link arm 76 swings about a fulcrum 76*a*, causing the fold plate 74 to move in the right-and-left direction in FIGS. 10 and 11. That is, a pin 75*b* studded on a fold plate cam 75 is movably received in an elongate slot 76*c* formed in the link arm 76, and the link arm 76 swings in accordance with the rotation movement of the fold plate cam 75, and in response to this movement, the fold plate 74 reciprocates in the direction perpendicular to a lower guide plate 91 and an upper guide plate 92 in FIG. 12.

The fold plate cam 75 is rotated in the direction of an arrow shown in FIG. 10 by a fold plate motor 166. The stop position of the fold plate cam 75 is determined by sensing both end portions of a semicircular interrupter portion 75*a* with a fold plate HP sensor 325.

FIG. 10 shows the position of the fold plate 74 in the home position where the fold plate 74 is fully retracted from the sheet stack housing range of the fold processing tray G. When the fold plate cam 75 is rotated in the direction of an arrow, the fold plate 74 is moved in the direction of the arrow and enters the sheet stack housing range of the fold processing tray G. FIG. 11 shows a position where the fold plate 74 pushes the center of the sheet stack on the fold tray G into the nip between the fold roller pair 81. When the fold plate cam 75 is rotated in the direction of an arrow, the fold plate 74 moves in the direction of the arrow and thereby retracts from the sheet stack housing range of the fold processing tray G.

In the first embodiment, with respect to center folding, to fold a sheet stack at the center is assumed, but the first embodiment is also applied to a case to fold a single sheet at the center. In such a case, because a single sheet does not have to be stapled at the center, at a time point when the sheet is discharged, the sheet is fed to the fold processing tray G side, folded by the fold plate 74 and the fold roller pair 81, and then discharged to the lower tray 203.

Next, the reinforce roller unit 400 will be described. As shown in FIG. 1, the reinforce roller unit 400 is provided on the path H between the fold roller pair 81 and an outlet roller pair 83. The sheet stack which has been folded by the fold plate 74 is pushed into the nip of the fold roller pair 81 and folded, and then the fold thereof is reinforced by the reinforce roller unit 400.

Figure 13:
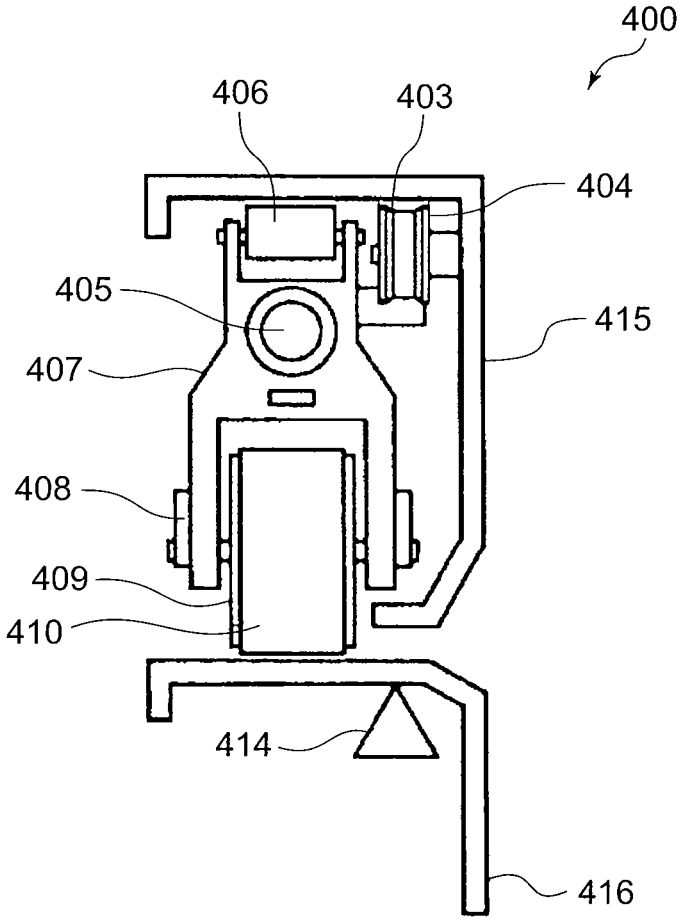
FIG. 13 is a front view of a reinforce roller unit in the first embodiment.
Figure 14:
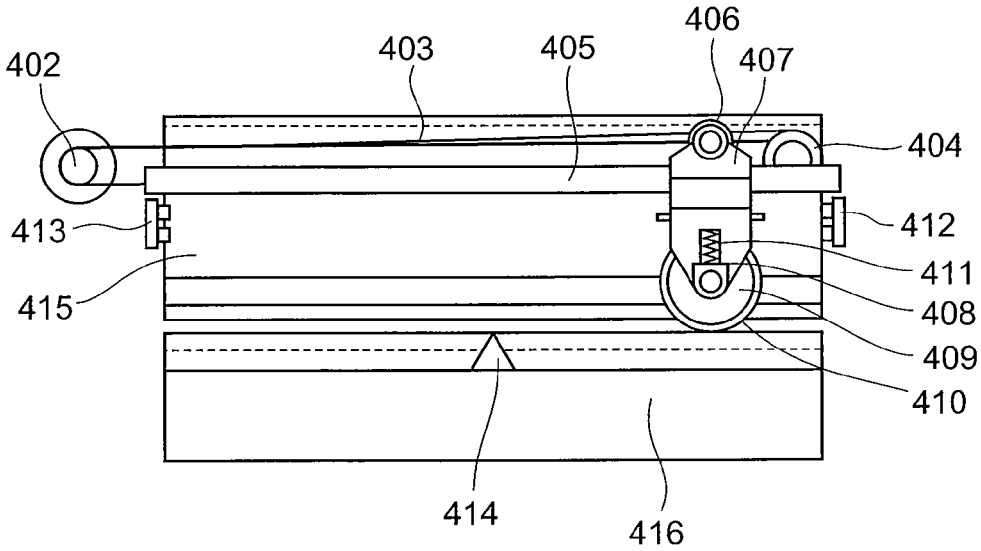
FIG. 14 is a side view of the reinforce roller unit in the first embodiment.

As shown in a plan view of FIG. 13 and a side view of FIG. 14, the reinforce roller unit 400 has a reinforce roller 409, a support mechanism of the reinforce roller 409, and a drive mechanism of the reinforce roller 409. The drive mechanism of the reinforce roller 409 includes a drive pulley 402, a driven pulley 404, an endless timing belt 403 which is passed over both the pulleys 402 and 404, and a DC motor 401 (FIG. 15) for driving the timing belt 403 to rotate. A pulse motor may be used in place of the DC motor 401.

The support mechanism of the reinforce roller 409 includes a support portion 407 which is connected with and moves integrally with the timing belt 403, a guide portion 405 to regulate the moving direction, an upper guide plate 415 which extends to the opposite side of the reinforce roller of the support portion 407, regulates the tilt of the reinforce roller 409, and prevents the guide portion 405 from bending, a roller support portion 408, a biasing member 411 (a coil spring in FIG. 14) as biasing means for biasing the reinforce roller 409 toward the folding direction of the sheet stack (downward in FIG. 13, FIG. 14). The support mechanism is arranged in the direction perpendicular to the sheet conveying direction, and the drive mechanism causes the reinforce roller 409 to move inside the support mechanism in the direction in which the support mechanism is arranged.

The rotation driving force of the DC motor 401 is transferred to the support portion 407 connected with the timing belt 403, via the timing belt 403 which is passed over the drive pulley 402 and the driven pulley 404, and the support portion 407 is guided by the guide portion 405 and moves while sliding in the thrust direction of the guide member 405. A bend-preventing portion 406 is provided between the support portion 407 and the upper guide plate 415, and is rotatably supported to the support portion 407, and being roller-shaped, the bend-preventing portion 406 can move integrally with the support portion 407 in the axial direction of the guide portion 405. The reinforce roller 409 is arranged between the support portion 407 and a lower guide plate 416, and a friction portion 410 is fitted on the circumference of the reinforce roller 409. The reinforce roller 409 moves back and forth.

The rotation axis of reinforce roller 409 is supported by the roller support portion 408, and the roller support portion 408 is supported in such a manner as to be movable in the up-and-down direction in sliding contact with the support portion 407. In addition, the roller support portion 408 is pressurized from the support portion 407 toward the lower guide plate 416 by the biasing member 411. In this configuration, the reinforce roller 409 can move in the thrust direction of the guide portion 405, integrally with the support portion 407, and during this time, the reinforce roller 409 is constantly pressurized toward the lower guide plate 416 by the biasing member 411, and moves in the up-and-down direction. In addition, a position sensor 412 and a position sensor 413 are provided at opposite sides in the thrust direction of the guide portion 405, as sensing means for sensing the position of the support portion 407. In case that the support portion 407 is positioned at positions of the position sensor 412 and the position sensor 413, the position sensors 412, 413 sense the support portion 407, respectively. A sheet stack sensor 414 senses a sheet stack conveyed to the reinforce roller unit 400.

The position sensor 413 senses the home position of the reinforce roller 409. After the sheet stack is conveyed to the prescribed position and stops, the reinforce roller 409 is moved from the position of the position sensor 413 to that of the position sensor 412 to perform the reinforcing operation. In this time, the number of pulses is counted, and in case that the reinforce roller 409 is not sensed by the position sensor 412 after counting a prescribed number of the pulses, that an abnormality (lock of the mechanism, stop due to an insufficient driving torque, step-out of the motor, sheet jam) occurs during the movement of the reinforce roller 409 is judged. Here, the term "sheet jam" means to become in a state in which the reinforce roller 409 abnormally stops during the reinforcing operation by the reinforce roller 409 and the sheet can not be conveyed.

When judged to be abnormal, the DC motor 401 is reversely rotated so as to return the reinforce roller 409 in the direction of the position sensor 413. In this time, an occurrence of a sheet jam is displayed on the display portion.

Figure 15:
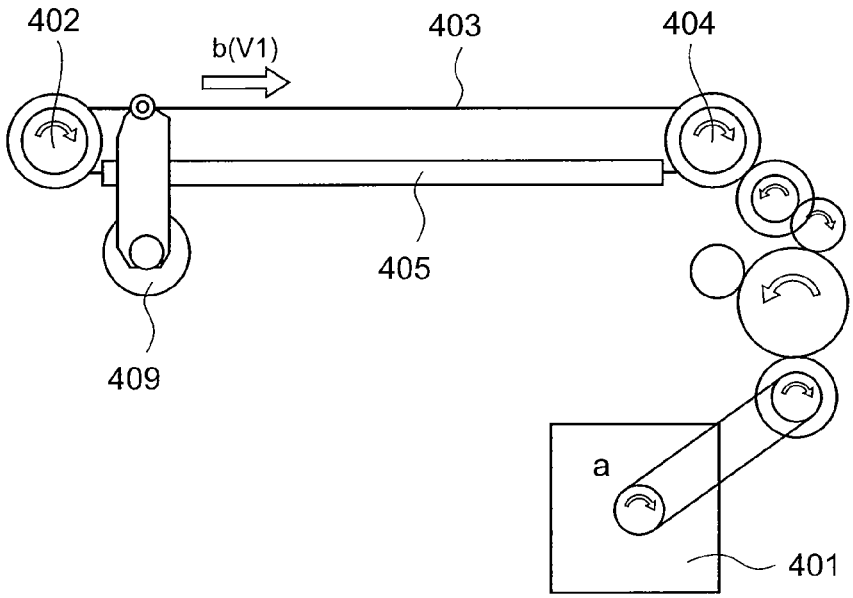
FIG. 15 is a view showing a motor movement (outward route) in the first embodiment.

FIG. 15 is a view showing a motor movement on an outward route. The rotation in the direction of a of the DC motor 401 is determined as a forward rotation, and the rotation in the direction reverse to the direction of a is determined as a reverse rotation. With the rotation of the DC motor 401 in the direction of a, gears, the drive pulley 404, the driven pulley 402, the timing belt 403 rotate forwardly. Along with these rotations, the reinforce roller 409 moves in the direction of an arrow b. A moving speed of the reinforce roller 409 in the direction of the arrow b that is the outward route during reinforcement is determined as V1.

Figure 16:
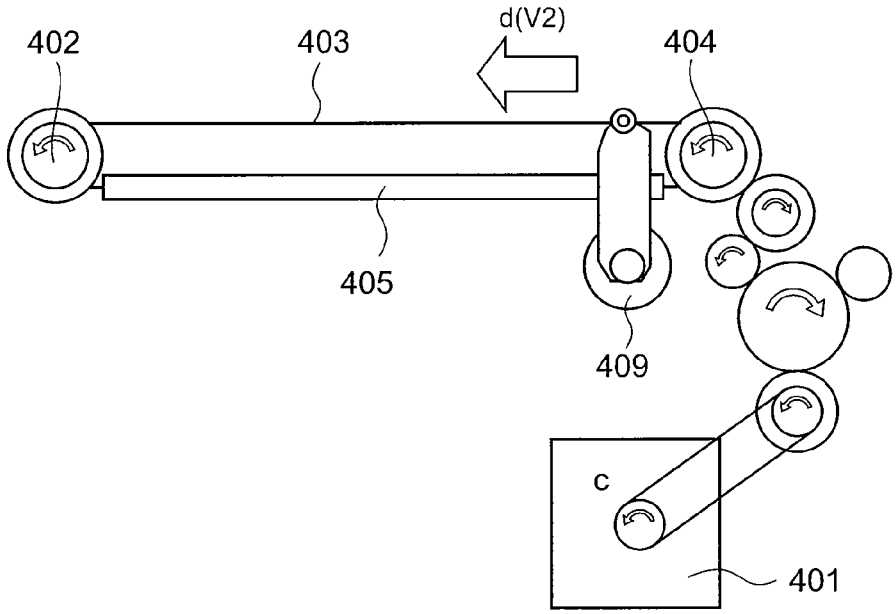
FIG. 16 is a view showing a motor movement (homeward route) in the first embodiment.

FIG. 16 is a view showing a motor movement on a homeward route. At the time of the homeward movement, the DC motor 401 rotates reversely (rotates in the direction of c). With the rotation of the DC motor 401 in the direction of c, gears, the drive pulley 404, the driven pulley 402, the timing belt 403 rotate reversely. Along with these rotations the reinforce roller 409 moves in the direction of an arrow d. A moving speed of the reinforce roller 409 in the direction of the arrow d that is the homeward route during reinforcement is determined as V2. The relation between the moving speed on the outward route and the moving speed on the homeward route is that V1<V2. In this time, the DC motor 401 is operated such that the rotation speed during the reverse rotation is faster that the rotation speed during the forward direction. The control unit 1500 controls the rotation speed of the DC motor 401 which drives the reinforce roller 409.

Figure 17:
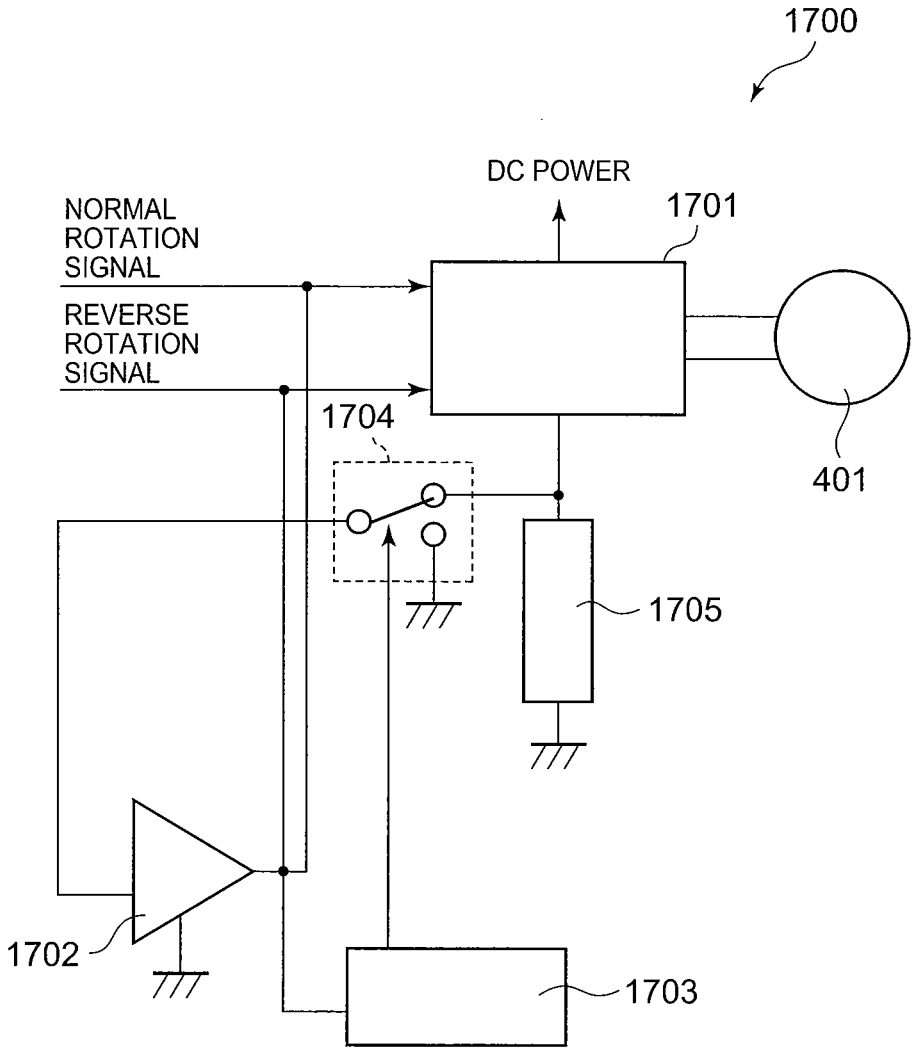
FIG. 17 is a DC motor drive circuit in the first embodiment.

FIG. 17 is a view showing a DC motor drive circuit 1700. The DC motor drive circuit 1700 has a motor H bridge circuit 1701, a current detecting circuit 1702, an excess current detecting circuit 1702, a changeover switch 1704 and a detecting resistance 1705. As shown in FIG. 17, the changeover switch 1704 is provided between the detecting resistance 1705 and the current detecting circuit 1702 in the DC motor drive circuit 1700, and thereby when the DC motor 401 can not be started within a definite period of time, the current limiting control may be released to thereby give a maximum current to the DC motor 401. That is, if the peak current continues for a definite period of time, the changeover switch 1704 is turned OFF, and detecting the current is stopped, thereby to cause the maximum current to flow into the DC motor 401.

Figure 18:
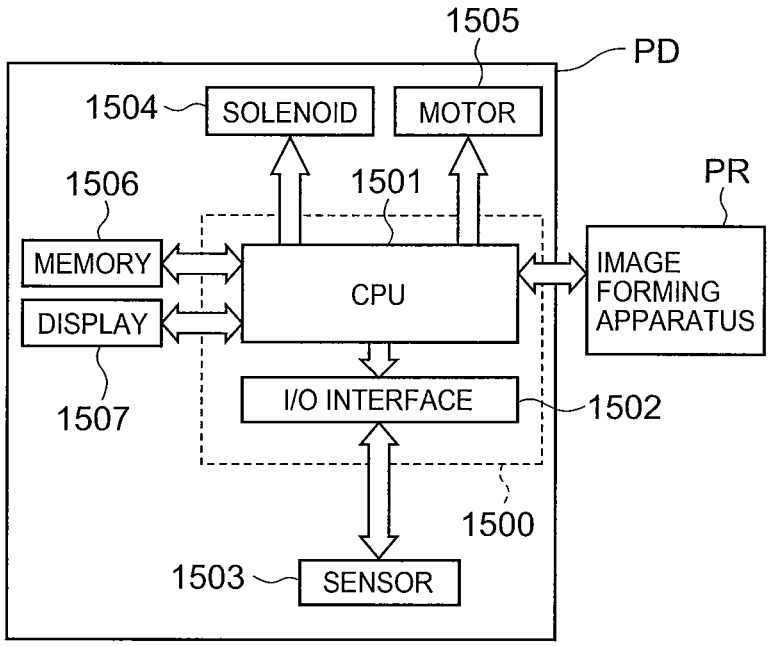
FIG. 18 is a block diagram showing a control of a sheet processing apparatus in the first embodiment.

FIG. 18 is a block diagram showing a control of the sheet processing apparatus. A control unit 1500 has a CPU 1501 and an I/O interface 1502. Signals from switches and so on of the control panel of the image forming apparatus PR and signals from sensors 1503 are inputted into the CPU 1500 via the I/O interface 1502. The CPU 1501 controls to drive a solenoid 1504 and a motor 1505 on the basis of the inputted signals.

Signals from the inlet sensor 301, the shift outlet sensor 303, the sheet surface sensor 330, the guide plate sensor 331, the sheet sensor 310, the HP sensor 311, the stapler HP sensor 312, the staple changing position sensor 313, the fold plate HP sensor 325, the position sensor 412, the position sensor 413 and the sheet stack sensor 414, for example, are inputted to the CPU 1501.

In order to control the finisher PD, the abnormality sensing control, and the display control for a display 1507, the CPU 1500 executes the program written in a memory 1506. In addition, a CPU provided in the image forming apparatus PR executes a display control for an operation and display unit in the image forming apparatus PR, in accordance with the control output of the CPU 1501.

Figure 19:
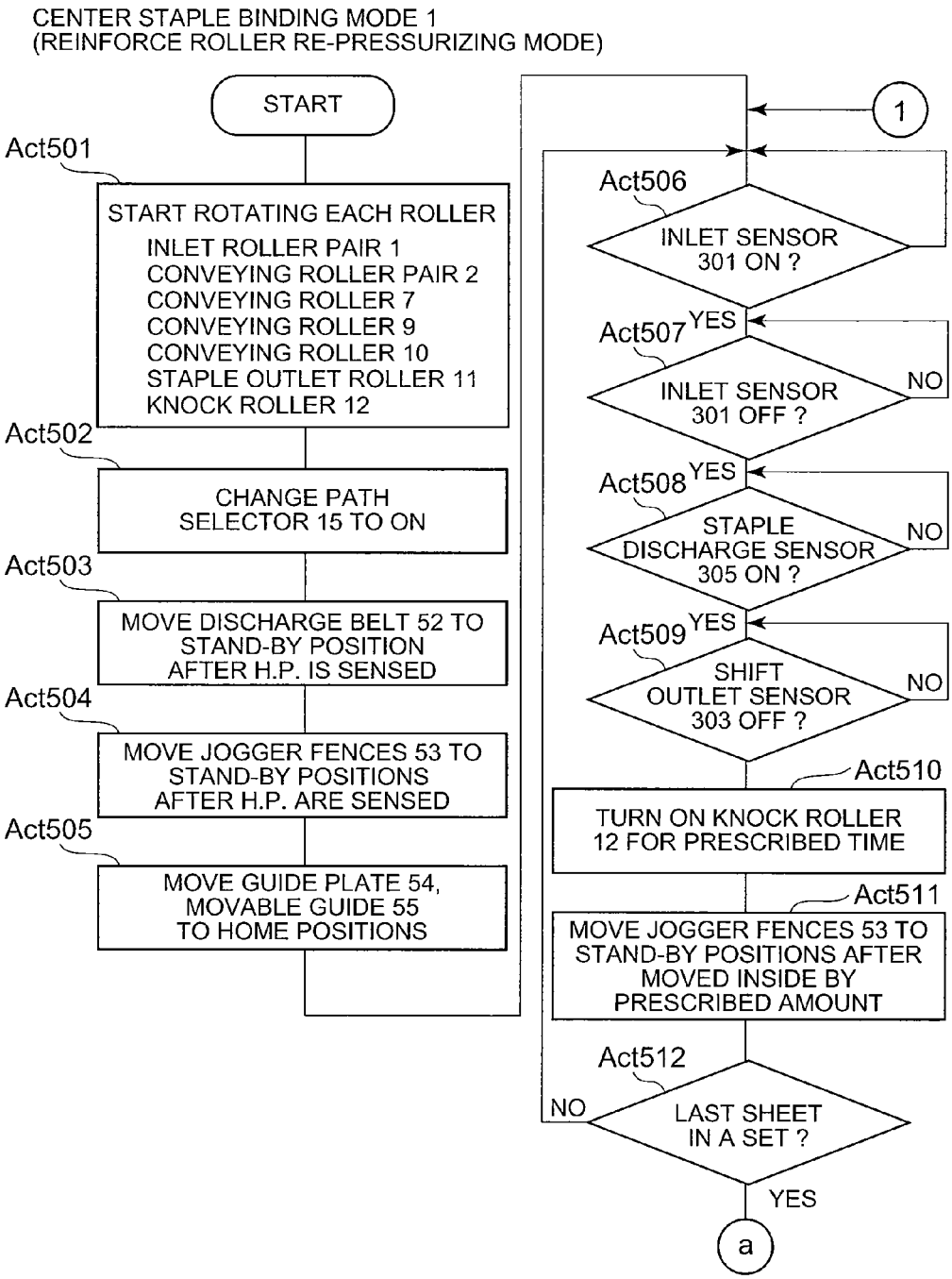
FIG. 19 is a flow chart 1 of a center staple binding mode in the first embodiment.
Figure 20:
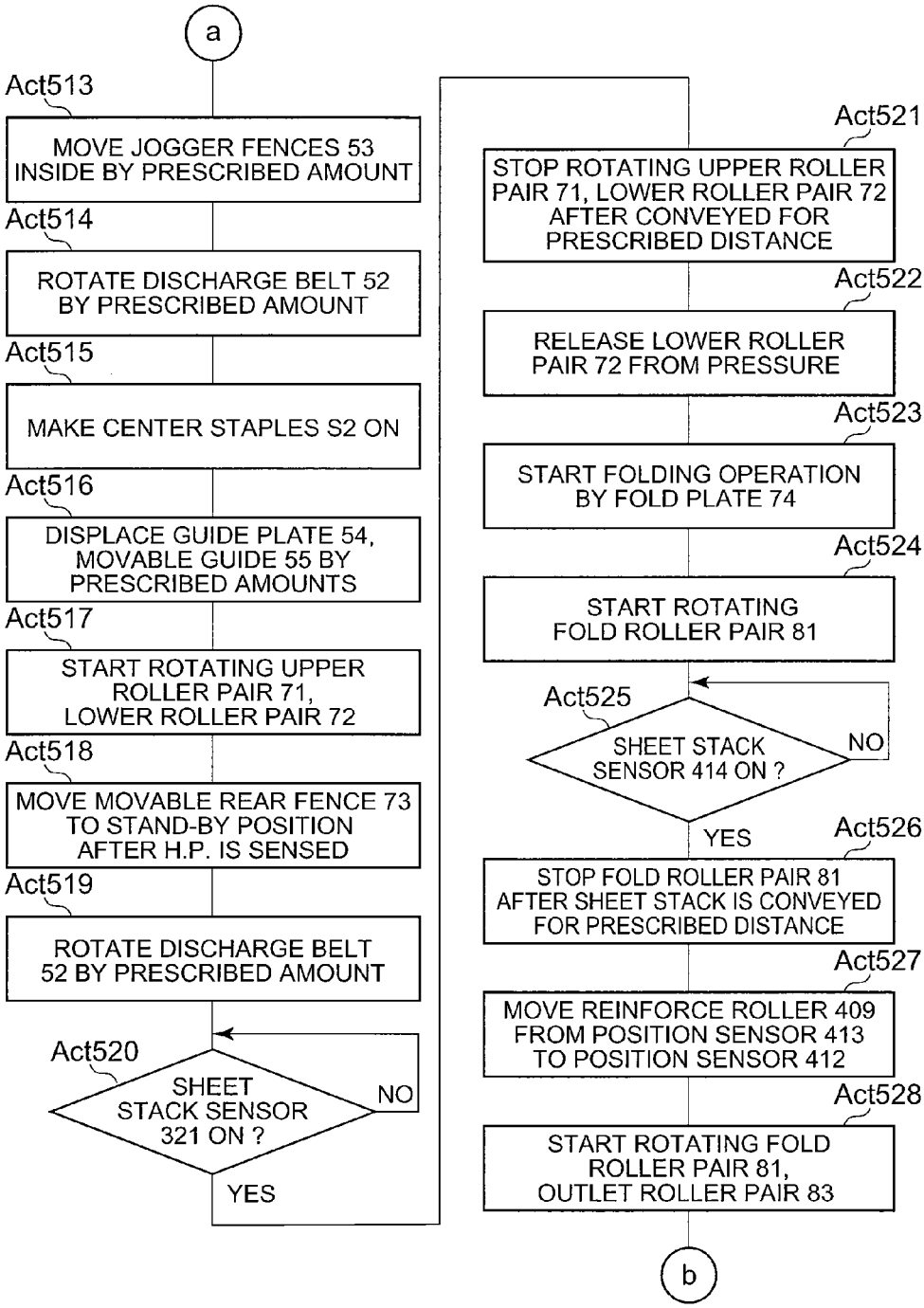
FIG. 20 is a flow chart 2 of a center staple binding mode in the first embodiment.
Figure 21:
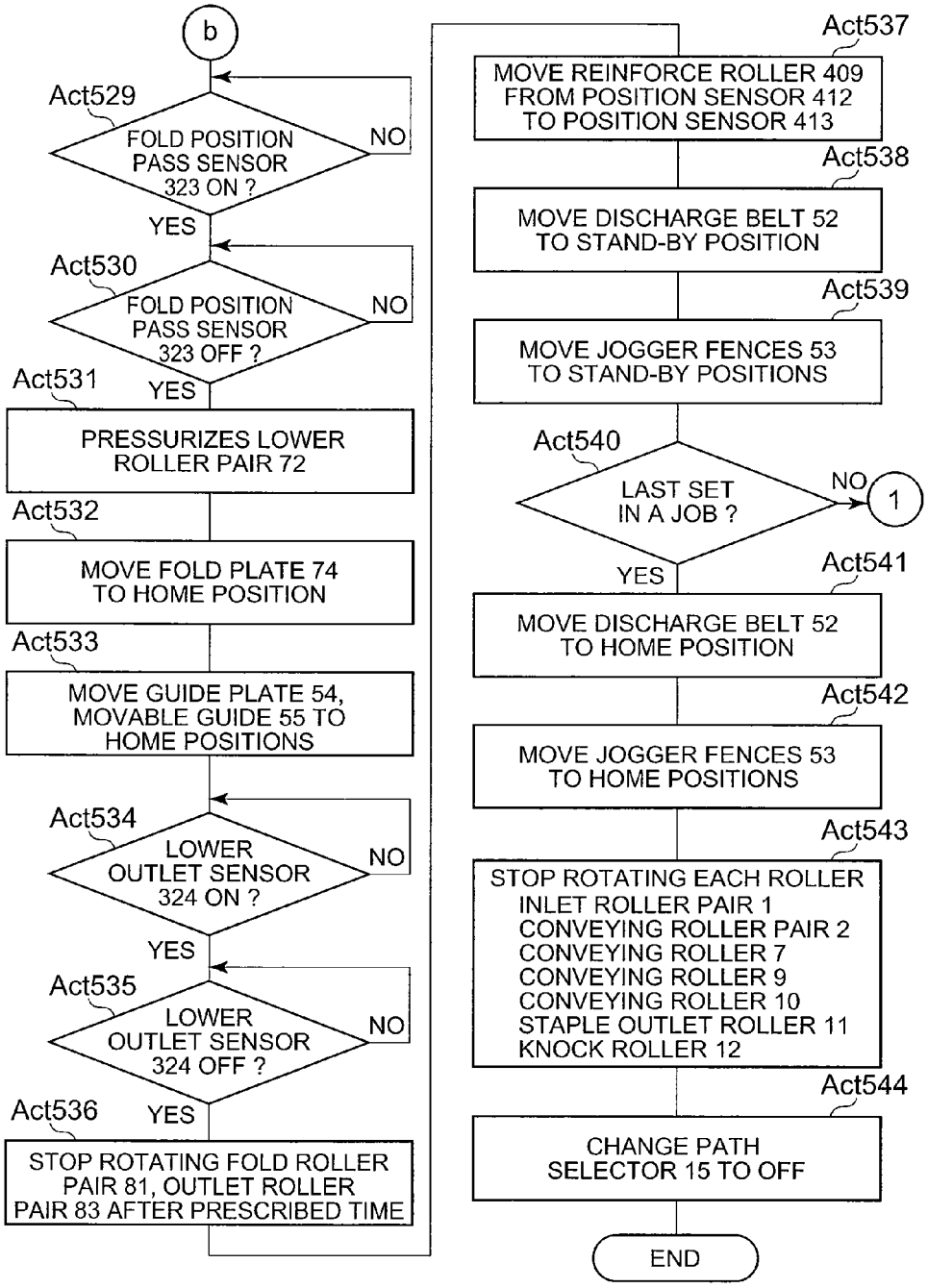
FIG. 21 is a flow chart 3 of a center staple binding mode in the first embodiment.

An operation of the finisher PD according to the first embodiment executed by the CPU 1501 will be described. FIG. 19 to FIG. 21 are flow charts showing processing procedures of a center staple binding mode according to the first embodiment, and these three figures shows a single processing.

This mode is a mode to convey sheets to the staple tray F via the path A and the path D, to fold the sheet stack at the center at the fold processing tray G after the sheets have been aligned and stapled at the center at the tray staple F, and to discharge the sheet stack which has been reinforced to the lower tray 203 via the path H.

As shown in FIG. 19, when an operation starts and the finisher PD is in the state where a sheet is conveyed from the image forming apparatus PR side, the inlet roller pair 1 and the conveying roller pair 2 of the path A, the conveying rollers 7, 9, 10 and the staple outlet roller 11 of the path D, and the knock roller 12 of the staple tray F in the finisher PD start rotating, respectively (Act501). And, the solenoid to drive the path selector 15 is turned ON (Act502), and then the path selector 15 is rotated in the counterclockwise direction.

Next, the home position of the discharge belt 52 is also sensed by the HP sensor 311, and after its position is confirmed, the discharge motor 157 is driven to cause the discharge belt 52 to move to the stand-by position, after the home positions of the jogger fences 53 are also sensed by the jogger fence HP sensor, the jogger fences 53 are moved to the stand-by positions, and in addition, the guide plate 54 and the movable guide 55 are moved to the home positions, respectively (Act503 to Act505).

If the inlet sensor 301 is ON, OFF (Act506, Act507), the staple discharge sensor 305 is ON (Act508), and the shift outlet sensor 303 is OFF (Act509), the sheet is discharged to the staple tray F, and because the sheet is present, the solenoid 170 is kept ON for a prescribed time to cause the knock roller 12 to contact with the sheet and to cause the sheet to be biased to the rear fences 51 side, and thereby the sheet is aligned at the back end (Act510). Next, the jogger motor 158 is driven to cause the jogger fences 53 to move inside by a prescribed amount, and thereby the sheet is aligned in the sheet width direction (the direction perpendicular to the sheet conveying direction), and then the jogger fences 53 are returned to the stand-by positions. (Act511). With these operations, the sheet which has been conveyed to the staple tray F is aligned in the longitudinal and crosswise directions (the direction in parallel and the direction perpendicular to the conveying direction).

The operations of these Act506 to Act512 are repeated for each sheet. Then, at the last sheet of a set (Y in Act512), as shown in the flow chart of FIG. 20, the jogger fences 53 are moved inside by a prescribed amount to cause a state where the end faces of the sheets are not shifted (Act513), and the discharge motor 157 is turned ON in this state to cause the discharge belt 52 to rotate by a prescribed amount (Act514) and to cause the sheet stack to be lifted up to the stapling position of the center staplers S2. Then at the central portion of the sheet stack, the center staplers S2 are made ON so as to perform center stapling (Act515). Next, the guide plate 54 and the movable guide 55 are displaced by prescribed amounts, respectively, to form a route toward the fold processing tray G (Act516), upper and lower roller pairs 71, 72 of the fold processing tray G are started rotating (Act517), and after the home position of the movable rear fence 73 of the fold processing tray G is sensed, the movable rear fence 73 is moved to the stand-by position (Act518).

When the sheet stack receiving system of the fold processing tray G is prepared, the discharge belt 52 is further rotated by a prescribed amount (Act519), and being sandwiched between the discharge roller 56 and a pressure roller 57, the sheet stack is conveyed to the fold processing tray G side. When the leading end of the sheet reaches the position of a sheet stack sensor 321 (Act520), and after the sheet stack is conveyed for a prescribed distance, the upper and lower roller pairs 71, 72 are stopped rotating (Act521), and the pressurized state of the lower roller pair 72 is released (Act522). Next, the folding operation by the fold plate 74 is started (Act523), and fold roller pair 81 and outlet roller pairs 83 are started rotating (Act524). The fold roller pair 81 is rotated till the sheet stack sensor 414 becomes ON, and when the sheet stack sensor 414 becomes ON (Y in Act525), after being rotated by a prescribed amount, the fold roller pair 81 is stopped (Act526). This operation is an operation to convey the leading end of the sheet stack to the reinforce roller pressurizing position.

The leading end of the sheet stack is conveyed to the position to be pressurized by the reinforce roller 409, and the fold roller pair 81 is stopped at the position to cause the sheet stack to be stopped (Act526). In this state, driving pulses are sent to the DC motor 401 for moving the reinforce roller 409 to cause the DC motor 401 to rotate, and thereby the reinforce roller 409 is moved from the position of the position sensor 413 to the position of the position sensor 412 (Act527), and the leading end of the sheet stack is pressurized by the reinforce roller 409. And, the fold roller pair 81 and the outlet roller pair 83 are started rotating (Act528).

As shown in the flow chart of FIG. 21, the passage of the sheet stack is monitored by a fold position pass sensor 323 (Act529, Act530), and when the fold position pass sensor 323 is turned OFF (Y in Act530), the lower roller pair 72 is pressurized (Act531), the hold plate 74 is moved to the home position (Act532), and in addition, the guide plate 54 and the movable guide 55 are also moved to the home positions, respectively (Act533). When the sheet stack passes through a lower outlet sensor 324 (Act534, Act535), after being rotated for a prescribed time, the fold roller pair 81 and the outlet roller pair 83 are stopped rotating (Act536). The reinforce roller 409 is moved from the position of the position sensor 412 to the position of the position sensor 413, and thereby is returned to the home position (Act537), and in addition, the discharge belt 52 and the jogger fences 53 are moved to the stand-by positions, respectively (Act538, Act539).

Figure 22:
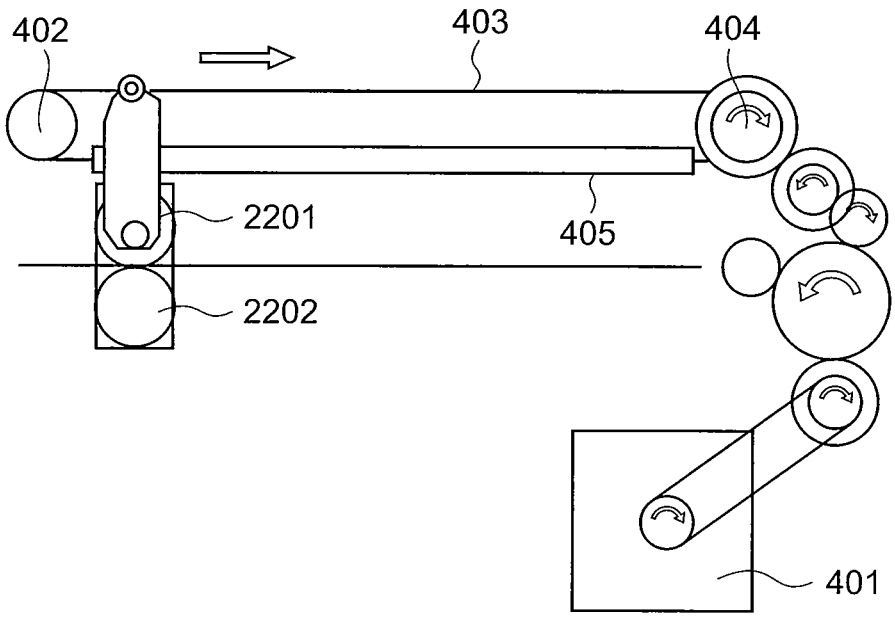
FIG. 22 is a view showing a reinforce roller composed of a roller pair in the first embodiment.

Whether or not it is the final set of a job is confirmed (Act540), and if it is not the final set of the job, the processing returns to the Act506 and the subsequent processing is repeated. If it is the final set, the discharge belt 52 and the jogger fences 53 are moved to the home positions, respectively (Act541, Act542), the inlet roller pair 1, the conveying rollers 2, 7, 9, 10, the staple outlet roller 11 and the knock roller 12 are stopped rotating (Act543), the sorting solenoid of the path selector 15 is made OFF (Act544), and thereby all are returned to their initial states and the processing is finished. The reinforce roller 409 may have an upper roller 2201 and a lower roller 2202 as shown in FIG. 22 and the fold may be reinforced by a nip formed with the roller pair.

The sheets carried in from the image forming apparatus PR are stapled at the center at the staple tray F, and folded at the center at the fold processing tray G, and in addition, after the fold is reinforced, the sheet stack which has been folded at the center is discharged and loaded on the lower tray 203.

At the time of reinforcing on the outward route, the reinforce roller 409 moves in the direction of the arrow b at the speed of V1 as shown in FIG. 15, and at the time of reinforcing on the homeward route, the reinforce roller 409 moves in the direction of the arrow d at the speed of V2 (V1<V2) as shown in FIG. 16.

With the above-described construction, the processing time for reinforcing the fold can be shortened.

Second Embodiment

A second embodiment, in case that the reinforce roller is made to reciprocate a plurality of times, a first reciprocation is performed at a low speed, and a second and subsequent reciprocations are performed at a high speed. The same symbols are given to the same constituent components as in the first embodiment.

Figure 23:
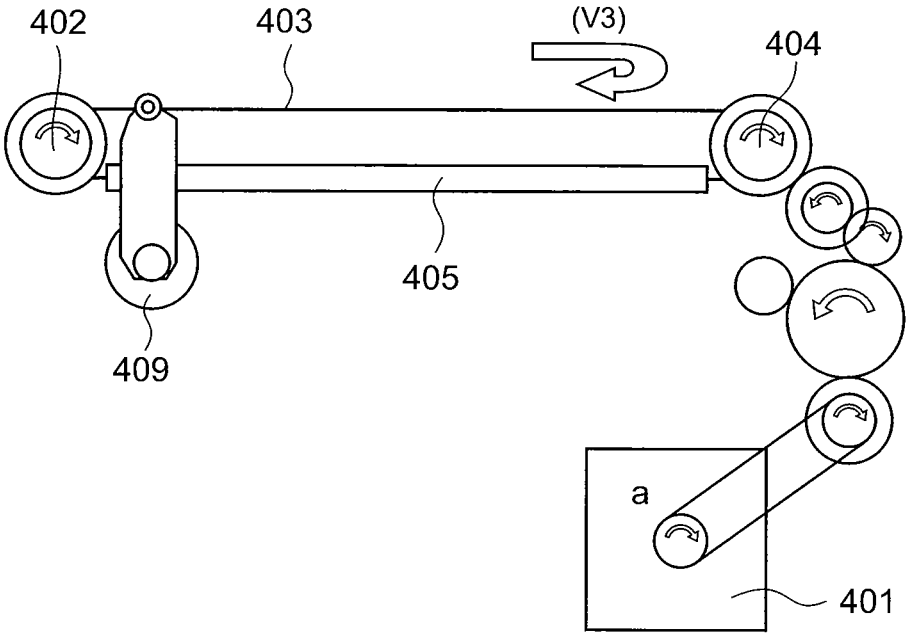
FIG. 23 is a view showing a motor movement (at a first reciprocation time) in a second embodiment.
Figure 24:
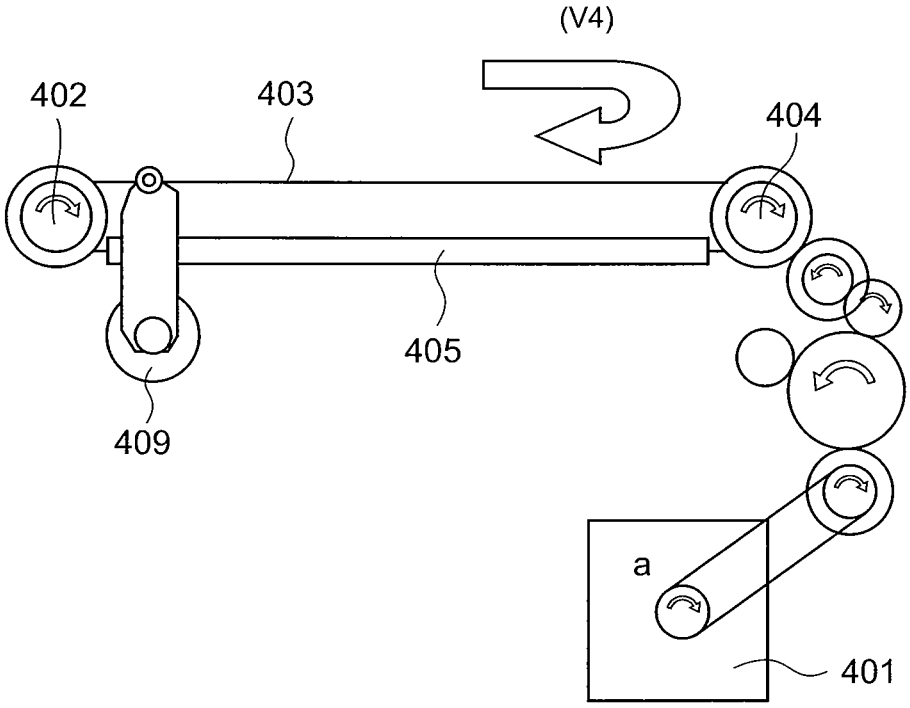
FIG. 24 is a view showing a motor movement (at a second and subsequent reciprocation times) in the second embodiment.

FIG. 23 is a view showing a motor movement in a first reciprocation according to the second embodiment, and FIG. 24 is a view showing a motor movement in a second and subsequent reciprocations. A reciprocating speed of the reinforce roller 409 is determined as V3 at the first time, and a reciprocating speed of the reinforce roller 409 is determined as V4 at the second and subsequent times. The relation between the reciprocating at the first time and the reciprocating speed at the second and subsequent times is that V3<V4.

At the first reciprocation time, the reinforce roller 409 moves at a speed of V3, as shown in FIG. 23, and at the second and subsequent reciprocation times, the reinforce roller 409 moves at a speed of V4 (V3<V4), as shown in FIG. 24. In addition, the reciprocating speed of the reinforce roller at a third and subsequent times may be not less than the reciprocating speed at a second time. That is, at the third and subsequent times, the reinforce roller 409 may be moved at a speed of V4 or a speed faster than V4.

With the above-described construction, the processing time for reinforcing the fold can be shortened. In addition, as the fold reinforcements are repeated, the more secure fold can be made.

While certain embodiments have been described, those embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

a fold roller pair to fold a sheet being pushed into a nip thereof;

a reinforce roller to reinforce a fold of the sheet folded by the fold roller pair;

a support portion to move the reinforce roller in a direction perpendicular to a sheet conveying direction;

a motor to drive the support portion; and a control unit to control the motor so that the support portion moves at a faster moving speed at the time of a homeward route than a moving speed at the time of an outward route, the motor having a changeover switch to release a limit control for a current in case the motor has not started within a definite time period after the current has reached a current limit.

2. The apparatus of claim 1, the motor rotating at a faster rotation speed at the time of a reverse rotation than a rotation speed at the time of a forward rotation.

3. The apparatus of claim 1, the changeover switch being provided between a current detecting circuit and a detecting resistance.

4. A sheet processing apparatus, comprising:

a fold roller pair to fold a sheet which passes through a nip between rollers of the fold roller pair;

a reinforce roller to reinforce the fold of the sheet which has been folded by the fold roller pair;

a motor to drive the reinforce roller; and a control unit to control the motor so that the reinforce roller moves at a faster reciprocation moving speed at a second and subsequent times than at a reciprocation moving speed at a first time.

5. The apparatus of claim 4, the reciprocation moving speed at a third and subsequent times being not less than the reciprocation moving speed at the second time.

6. A sheet forming system, comprising:

a sheet processing apparatus, including:

a fold roller pair to fold a sheet being pushed into a nip thereof;

a reinforce roller to reinforce a fold of the sheet folded by the fold roller pair;

a support portion to move the reinforce roller in a direction perpendicular to a sheet conveying direction;

a motor to drive the support portion; and a control unit to control the motor so that the support portion moves at a faster moving speed at the time of a homeward route than a moving speed at the time of an outward route, the motor having a changeover switch to release a limit control for a current in case the motor has not started within a definite time period after the current has reached a current limit; and an image forming apparatus including:

an image forming unit to form an image on a sheet based on inputted image information; and a sheet feeding unit to feed the sheet to the image forming unit.

7. The system of claim 6, the motor rotating at a faster rotation speed at the time of a reverse rotation than a rotation speed at the time of a forward rotation.

8. The system of claim 6, the changeover switch being provided between a current detecting circuit and a detecting resistance.

9. A sheet forming system, comprising:

a sheet processing apparatus, including:

a fold roller pair to fold a sheet which passes through a nip between rollers of the fold roller pair;

a reinforce roller to reinforce the fold of the sheet which has been folded by the fold roller pair;

a motor to drive the reinforce roller; and a control unit to control the motor so a reciprocation moving speed of the reinforce roller is faster at a second and subsequent times than at a first time; and an image forming apparatus including:

an image forming unit to form an image on a sheet based on inputted image information; and a sheet feeding unit to feed the sheet to the image forming unit.

10. The system of claim 9, the reciprocation moving speed at a third and subsequent times being not less than the reciprocation moving speed at the second time.

11. The system of claim 9, the motor including a DC motor.

12. The system of claim 9, the motor including a pulse motor.

13. The system of claim 9, the motor having a changeover switch to release a limit control for a current in case the motor has not started within a definite time period after the current has reached a current limit.

14. A sheet forming method, comprising:

folding a sheet being pushed into a nip of a fold roller pair;

reinforcing a fold of the sheet folded by the fold roller pair by a reinforce roller;

driving the reinforce roller by a motor;

controlling the motor so that the reinforce roller moves at a faster reciprocation moving speed at a second and subsequent times than at a reciprocation moving speed at a first time;

forming an image on a sheet based on inputted image information by an image forming unit; and feeding the sheet to the image forming unit.

15. The method of claim 14, the reciprocation moving speed at a third and subsequent times being not less than the reciprocation moving speed at the second time.

16. The method of claim 14, the motor having a changeover switch to release a limit control for a current in case the motor has not started within a definite time period after the current has reached a current limit.

* * * * *